US006219859B1

(12) United States Patent
Derakhshan

(10) Patent No.: US 6,219,859 B1
(45) **Date of Patent: *Apr. 24, 2001**

(54) CABINET DOOR OPERATED FAUCET VALVE

(76) Inventor: Soheyl Derakhshan, 5355 Pacifica Dr., San Diego, CA (US) 92109

( * ) Notice: Subject to any disclaimer, the term of this patent is extended or adjusted under 35 U.S.C. 154(b) by 0 days.

This patent is subject to a terminal disclaimer.

(21) Appl. No.: 09/546,902

(22) Filed: Apr. 10, 2000

Related U.S. Application Data

(63) Continuation-in-part of application No. 09/166,667, filed on Oct. 5, 1998, now Pat. No. 6,047,417.

(51) Int. Cl.[7] ..... E03C 1/04

(52) U.S. Cl. ..... 4/677; 4/675; 4/623; 137/599; 137/884; 251/295

(58) Field of Search ..... 4/675–678, 623, 4/624, 626, 630, 638; 137/599, 884, 337; 138/31; 251/295, 129.04

(56) References Cited

U.S. PATENT DOCUMENTS 4,757,943 * 7/1988 Sperling et al. ..... 137/599
5,322,086 * 6/1994 Sullivan ..... 137/599
5,385,172 * 1/1995 Perrott et al. ..... 138/31
5,749,388 * 5/1998 Elliot et al. ..... 137/1
6,047,417 * 4/2000 Derakshan ..... 4/677
6,059,192 * 5/2000 Zosimadis ..... 4/623

* cited by examiner

*Primary Examiner*—Gregory L. Huson
*Assistant Examiner*—Tuan Nguyen
(74) *Attorney, Agent, or Firm*—Lyon & Lyon LLP

(57) ABSTRACT

An automatic control system for a faucet of a sink includes a valve manifold adapted to be disposed beneath the sink. The valve manifold is adapted to communicate with at least one of a hot water supply line and a cold water supply line and at least one of a hot water faucet connecting line and a cold water faucet connecting line for delivering water to the faucet of the sink. The valve manifold includes at least one electrically actuatable valve for controlling the flow of water to at least one of the hot water faucet connecting line and the cold water faucet connecting line and a diversionary valve adapted to allow water in the valve manifold to bypass the at least one electrically actuatable valve and flow to at least one of the hot water faucet connecting line and the cold water faucet connecting line.

28 Claims, 13 Drawing Sheets

CABINET DOOR OPERATED FAUCET VALVE

This application is a continuation-in-part of U.S. application Ser. No. 09/166,667, filed on Oct. 5, 1998, which will issue as U.S. Pat. No. 6,047,417 on Apr. 11, 2000.

BACKGROUND OF THE INVENTION

1. Field of the Invention

The present invention relates generally to sink faucets and, more specifically, to an automatic valve control system for remotely activating a water faucet.

2. Description of the Prior Art

Remote and automatic control of a sink faucet go back many years. In early years, the use of photo cells and foot pedals were common, and, more recently, the use of electronic proximity switches has become widespread. The introduction of numerous electronic controlled faucets in recent years points to the need of a functional multipurpose remote and automatic sink faucet control system. Besides the protection from transfer of bacteria and the convenience of hand free operations, the water saving potential and capability of a reliable, low maintenance, functional system will make such a device a necessity rather than a luxury.

Unfortunately, the electronic and foot pedal versions of faucet control valves have demonstrated many limitations and short falls, making the need for a more practical and user friendly device for households even more apparent. The existing electronic version of the faucet control valve limits its use for simple hand washing application. Its indiscriminate actuation by sensing an object makes this type of valve faucet useless for any other application that requires instantaneous on/off control of water flow. The uncontrolled and indiscriminate actuation by proximity or motion sensing devices make simple tasks such as dishwashing, clothes washing, or even sink cleaning a self defeating act. Other disadvantages of electronic faucets are the lack of control over the water flow and ability to override the system. In case of power failure, these units can only rely on limited storage capacity of the battery cells.

Furthermore, because the components of the electronic faucets are interdependent and inseparable, they replace the existing faucet without making any use of it. Also, because of extensive electronic circuitry and its related high cost, plus their functional limitations, the electronic faucets are most suitable only for newly built public hand washing facilities where high cost and limitations are not of any major concern.

Similarly, the floor mounted foot pedal is an obtrusive device, difficult to use and to install and requires extensive plumbing changes. The foot pedals' bulky space-taking body makes floor cleaning difficult and becomes an obstacle to foot traffic. Its use by the elderly and some physically impaired individuals is also limited. Due to extensive plumbing changes and its related high cost, foot pedal sink faucet controls are only suitable for institutional use. The impracticality, inconvenience, difficulty of installation and high cost of existing devices necessitates the need for a new device that is practical, responsive, easy to use, easy to install, and low cost.

To work in the consumer market, an automatic faucet control must be a retrofitted appliance, sold as a kit to be installed by consumer, which uses the existing plumbing and fixtures, and is responsive to almost every demand that one may expect from a faucet. To accommodate the existing plumbing and accessories such as water filters, ice makers, and auxiliary water heaters, the auto faucet inlet ports must be numerous and strategically placed for all conceivable connecting situations. The low cost, user-friendliness, and ease of installation would play a crucial role in success of such a product. To be practical it should be possible for a consumer to override the automation easily and conveniently. In the case of power failure, the consumer must be able to bypass the system with ease.

SUMMARY OF THE INVENTION

The instant invention fulfills the above stated needs by providing an automatic control system for a faucet of a sink, the automatic control system including a valve manifold adapted to be disposed beneath the sink, the valve manifold adapted to communicate with at least one of a hot water supply line and a cold water supply line and at least one of a hot water faucet connecting line and a cold water faucet connecting line for delivering water to the faucet of the sink, the valve manifold including at least one electrically actuatable valve for controlling the flow of water to at least one of the hot water faucet connecting line and the cold water faucet connecting line, the at least one electrically actuatable valve adapted to electrically communicate with an electrical power supply, and at least one switch adapted to selectively cause a connection between the electrical power supply and the at least one electrically actuatable valve to be completed, whereby, upon completion of the connection, the at least one electrically actuatable valve at least partially opens to allow the flow of water to the faucet, and the valve manifold including a diversionary valve adapted to allow water in the valve manifold to bypass the at least one electrically actuatable valve and flow to at least one of the hot water faucet connecting line and the cold water faucet connecting line.

Implementation of the above aspect of the invention may include one or more of the following. The diversionary valve includes a manually operable diversionary valve. The diversionary valve includes an automatic electrically actuatable diversionary valve adapted to open when power ceases to be supplied to the automatic electrically actuatable diversionary valve. The automatic electrically actuatable diversionary valve includes a biasing mechanism adapted to urge the automatic electrically actuatable diversionary valve closed when the automatic electrically actuatable diversionary valve is supplied with electricity and urge the automatic electrically actuatable diversionary valve open when the automatic electrically actuatable diversionary valve is not supplied with electricity. The biasing mechanism includes an electromagnetic mechanism adapted to close the automatic electrically actuatable diversionary valve when the electromagnetic mechanism is supplied with electricity and a spring adapted to open the automatic electrically actuatable diversionary valve when electricity is not supplied to the electromagnetic mechanism. The valve manifold is adapted to be disposed beneath the sink, inside a cabinet frame having a pair of hinged doors mounted thereon, the at least one switch adapted to be mounted to the cabinet frame, at least one of the doors including an internal surface facing the inside of the cabinet and adapted to contact the at least one switch when the at least one door is substantially closed, the at least one switch adapted to be activated by the internal surface of the at least one door when pressure is applied to an external surface of the at least one door. The at least one switch includes a latching switch that, upon being activated a first time, maintains completion of the connection of the electrical power supply and the solenoid valves until the switch is reactivated. The at least one switch includes a momentarily non-latching switch. The at least one switch and the at least one valve are adapted to provide variable flow control in the valve manifold proportionate to the amount of pressure applied to the external surface of the at least one door. The at least one switch includes a variable-resistance push switch and the at least one electrically actuatable valve includes a servo valve. The automatic control system further includes a wireless mechanism adapted to communicate the at least one switch with the at least one electrically actuatable valve to control the at least one electrically actuatable valve. The wireless mechanism includes a transmitter associated with the at least one switch, and a receiver and a control unit associated with the valve manifold, the transmitter is adapted to transmit a signal indicative of the state of the at least one switch to the receiver which communicates the signal to the control unit for control of the at least one electrically actuatable valve.

An additional aspect of the invention includes an automatic control system for a faucet of a sink, the automatic control system including a valve manifold adapted to be disposed beneath the sink, inside a cabinet frame having a pair of hinged doors mounted thereon, the valve manifold adapted to communicate with at least one of a hot water supply line and a cold water supply line and at least one of a hot water faucet connecting line and a cold water faucet connecting line for delivering water to the faucet of the sink, the valve manifold including at least one electrically actuatable valve for controlling the flow of water to at least one of the hot water faucet connecting line and the cold water faucet connecting line, the at least one electrically actuatable valve adapted to electrically communicate with an electrical power supply, at least one switch adapted to be mounted to the cabinet frame, at least one of the doors including an internal surface facing the inside of the cabinet and adapted to contact the at least one switch when the at least one door is substantially closed, the at least one switch adapted to be selectively activated by the internal surface of the at least one door when pressure is applied to an external surface of the at least one door so as to cause a connection between the electrical power supply and the at least one electrically actuatable valve to be completed, whereby, upon completion of the connection, the at least one valve at least partially opens to allow the flow of water to the faucet.

Implementations of the aspect of the invention described immediately above may include one or more of the following. The at least one switch includes a mechanical or electronic latching switch that, upon being activated a first time, maintains completion of the connection of the electrical power supply and the solenoid valves until the switch is reactivated. The at least one switch includes a momentarily non-latching switch. The at least one switch and the at least one valve are adapted to provide variable flow control in the valve manifold proportionate to the amount of pressure applied to the external surface of the at least one door. The at least one switch includes a variable-resistance push switch and the at least one electrically actuatable valve includes a servo valve. The automatic control system further includes a wireless mechanism adapted to communicate the at least one switch with the at least one electrically actuatable valve to control the at least one electrically actuatable valve. The wireless mechanism includes a transmitter associated with the at least one switch, and a receiver and a control unit associated with the valve manifold, the transmitter adapted to transmit a signal indicative of the state of the at least one switch to the receiver which communicates the signal to the control unit for control of the at least one electrically actuatable valve. The valve manifold includes a diversionary valve adapted to allow water in the valve manifold to bypass the at least one electrically actuatable valve and allow flow to at least one of the hot water faucet connecting line and the cold water faucet connecting line. The diversionary valve includes a manually operable diversionary valve. The diversionary valve includes an automatic electrically actuatable diversionary valve adapted to open when power ceases to be supplied to the automatic electrically actuatable diversionary valve. The automatic electrically actuatable diversionary valve includes a biasing mechanism adapted to urge the automatic electrically actuatable diversionary valve closed when the automatic electrically actuatable diversionary valve is supplied with electricity and urge the automatic electrically actuatable diversionary valve open when the automatic electrically actuatable diversionary valve is not supplied with electricity. The biasing mechanism includes an electromagnetic mechanism adapted to close the automatic electrically actuatable diversionary valve when the electromagnetic mechanism is supplied with electricity and a spring adapted to open the automatic electrically actuatable diversionary valve when electricity is not supplied to the electromagnetic mechanism. The at least one switch includes a switch adapted to be activated by an upper side of a user's foot. The at least one switch includes a static sensitive switch connected to an uncoated metallic sink, a metallic faucet or numerous metallic ornamental probes placed in a location of convenience such as a sink countertop and all being isolated from the ground and to be activated by the user's touch.

DETAILED DESCRIPTION OF THE PREFERRED EMBODIMENT

Figure 1:
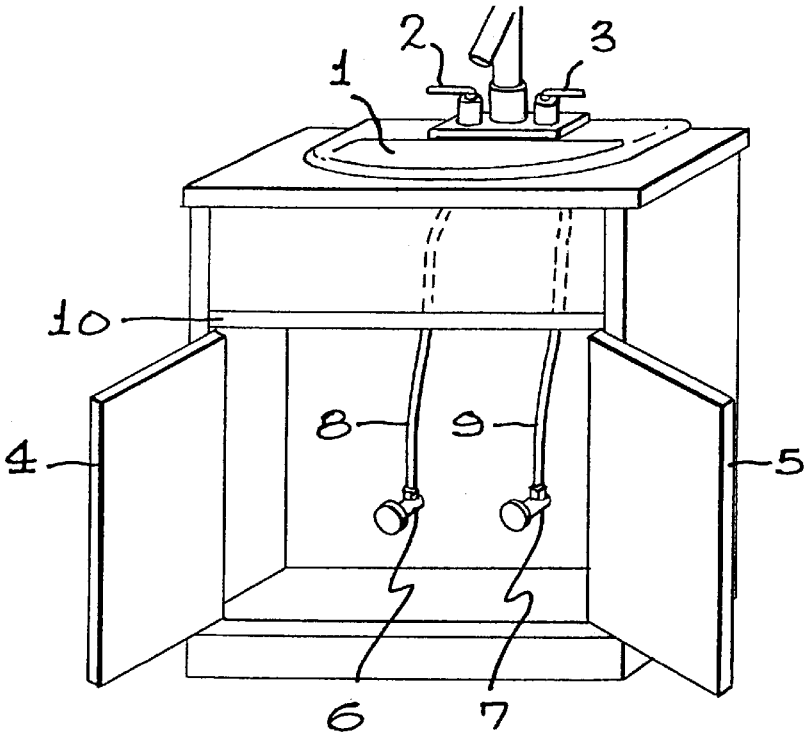
FIG. 1 PRIOR ART
FIG. 1 is a perspective view of a prior art hand or dish washing faucet, plumbing, sink, and cabinet shown with the cabinet doors open.

With reference to FIG. 1, a prior art sink 1, faucet with faucet valves 2, 3, sink cabinet with doors 4, 5, supply gland nuts 6, 7, connecting tubes 8, 9, and upper door frame 10 are shown. The sink faucet valves 2, 3 are connected by tubes 8, 9 to the supply valve gland nuts 6, 7. The cabinet doors 4, 5 are hingeable connected to the cabinet frame and, when closed, an upper inside part of each door 4, 5 rests adjacent to or against the upper door frame 10.

With reference to FIGS. 2, 3, and 5–8, a valve manifold 17 constructed in accordance with an embodiment of the present invention is shown. During installation of the valve manifold 17, the gland nuts 6, 7 are first removed, two of the valve manifold inlet ports 11, 12 are connected to the gland nuts 6, 7 via supply tubes 15, 16, and the faucet connecting tubes 8, 9 are then connected to the valve manifold outlet ports 13, 14. The inlet ports 11, 12 not connected to the supply tubes 15, 16 may be capped or may be coupled to other appliances that require water, e.g., ice makers, water filtration devices, auxiliary water heater for coffee or tea making purposes.

Figure 2:
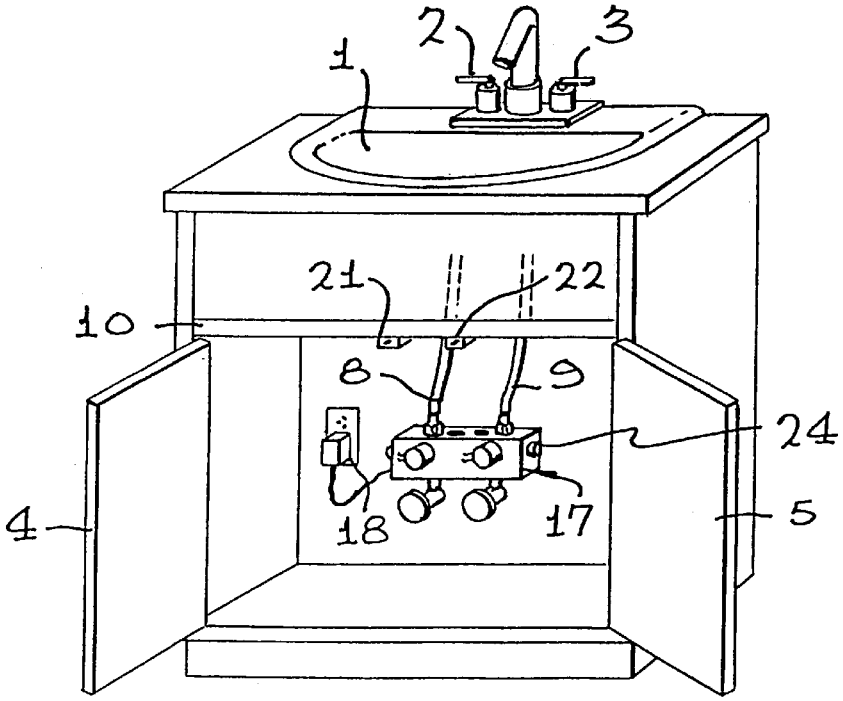
FIG. 2 is a perspective view of the faucet, plumbing, sink, and cabinet shown in FIG. 1 retrofitted with an automatic faucet control valve system constructed in accordance with an embodiment of the present invention.
Figure 3:
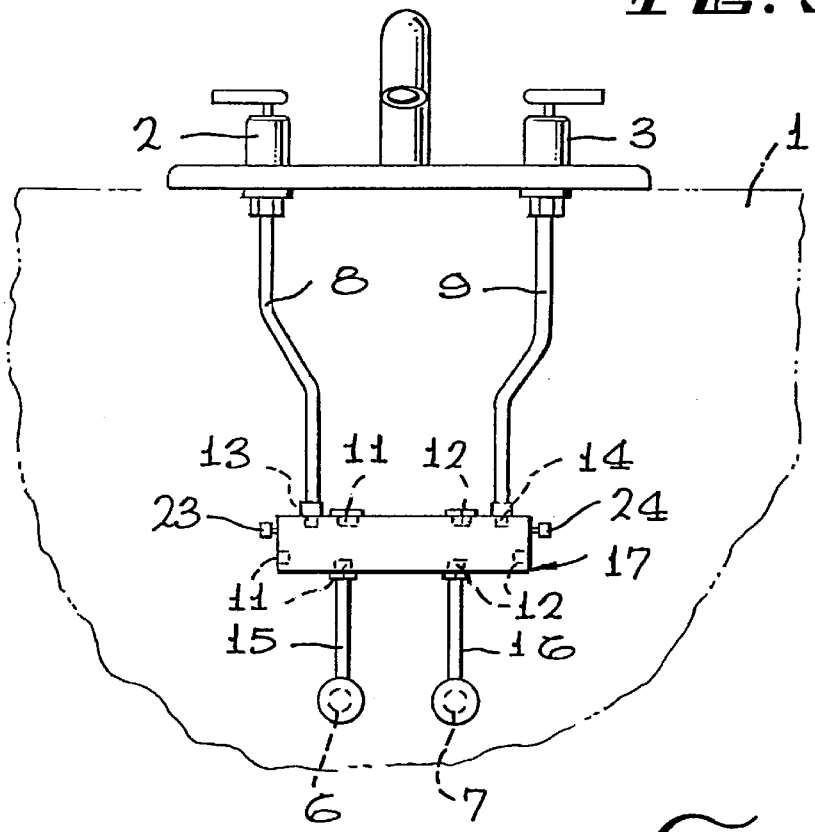
FIG. 3 is a front, partially broken-away view of the faucet, plumbing, sink, automatic faucet control valve, and cabinet shown in FIG. 2.
Figure 4:
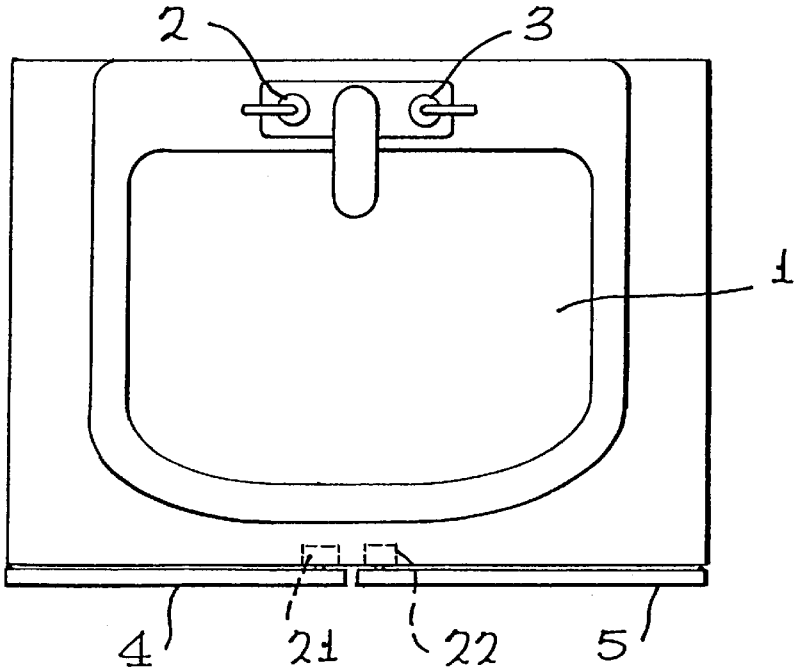
FIG. 4 is a top plan view of the sink and cabinet of FIG. 2 and shows an embodiment of the controlling switches in an exemplary location on the cabinet frame.
Figure 5:
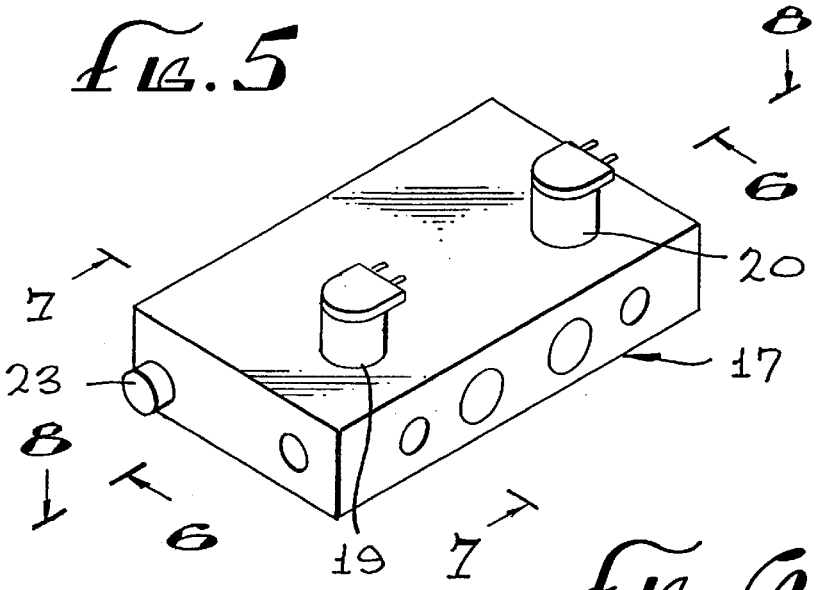
FIG. 5 is a perspective view of an embodiment of the valve manifold of the automatic faucet control valve system.
Figure 10:
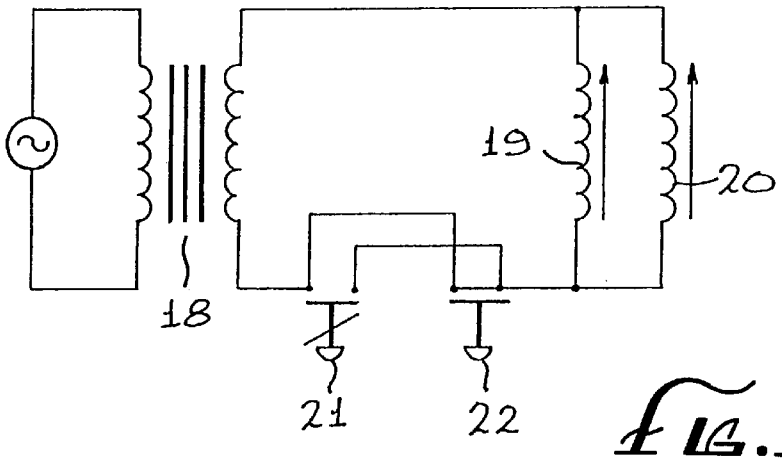
FIG. 10 is an exemplary simplified circuit diagram of an embodiment of the automatic faucet control valve system.

In the embodiment of the controlling switches 21, 22 shown in FIGS. 2, 4 and 10, the controlling switches 21, 22 are normally opened push button switches and controlling switch 21 is a latching switch and the controlling switch 22 is a momentary switch. In alternative embodiments of the invention, the opposite may be true, only one of the above types of switches may be used, or, as will become better understood below, one or more of these types of switches and a different type of switch may be installed on a cabinet, giving the user more selectivity.

The controlling switches 21, 22 are preferably connected to a central portion of the inside upper door frame 10, inside of the cabinet. Although the controlling switches are shown connected near the center of the inside upper door frame, it will be readily apparent to those skilled in the art that the controlling switches 21, 22 may be positioned in locations on the inside upper door frame 10 other than that shown and may be connected to other elements of a cabinet other than that shown. For example, but not by way of limitation, the controlling switches 21, 22 may be connected to the inside faces of the doors 4, 5 or a center frame (not shown) of the cabinet. The switches 21, 22 should be located so that when a user applies gentle pressure with his or her knee to the exterior surface of the cabinet door, when the door is substantially closed, this pressure will cause the corresponding switch 21, 22 to close.

Figure 9:
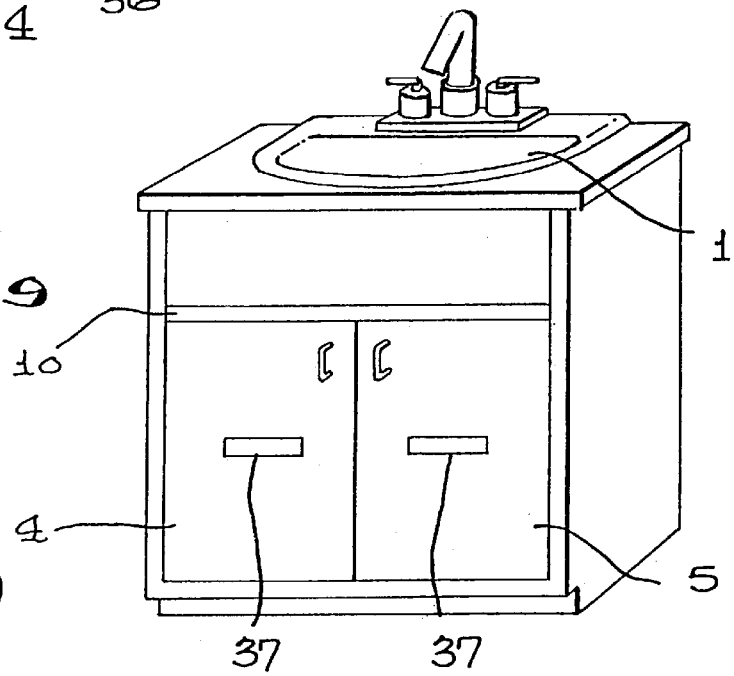
FIG. 9 is a perspective view of a faucet, sink, and cabinet retrofitted with an automatic faucet control valve system with the cabinet doors closed to show another embodiment of the controlling switches in the form of mounted switch pads in an exemplary location on an external side of the cabinet doors.

With reference to FIG. 9, in an alternative embodiment of the invention, the switches 21, 22 may instead be activated by pressure sensitive switch pads 37 mounted on the exterior surface of the cabinet doors. This embodiment advantageously immediately makes the user aware that the sink is equipped with a cabinet door faucet valve system.

Figure 12:
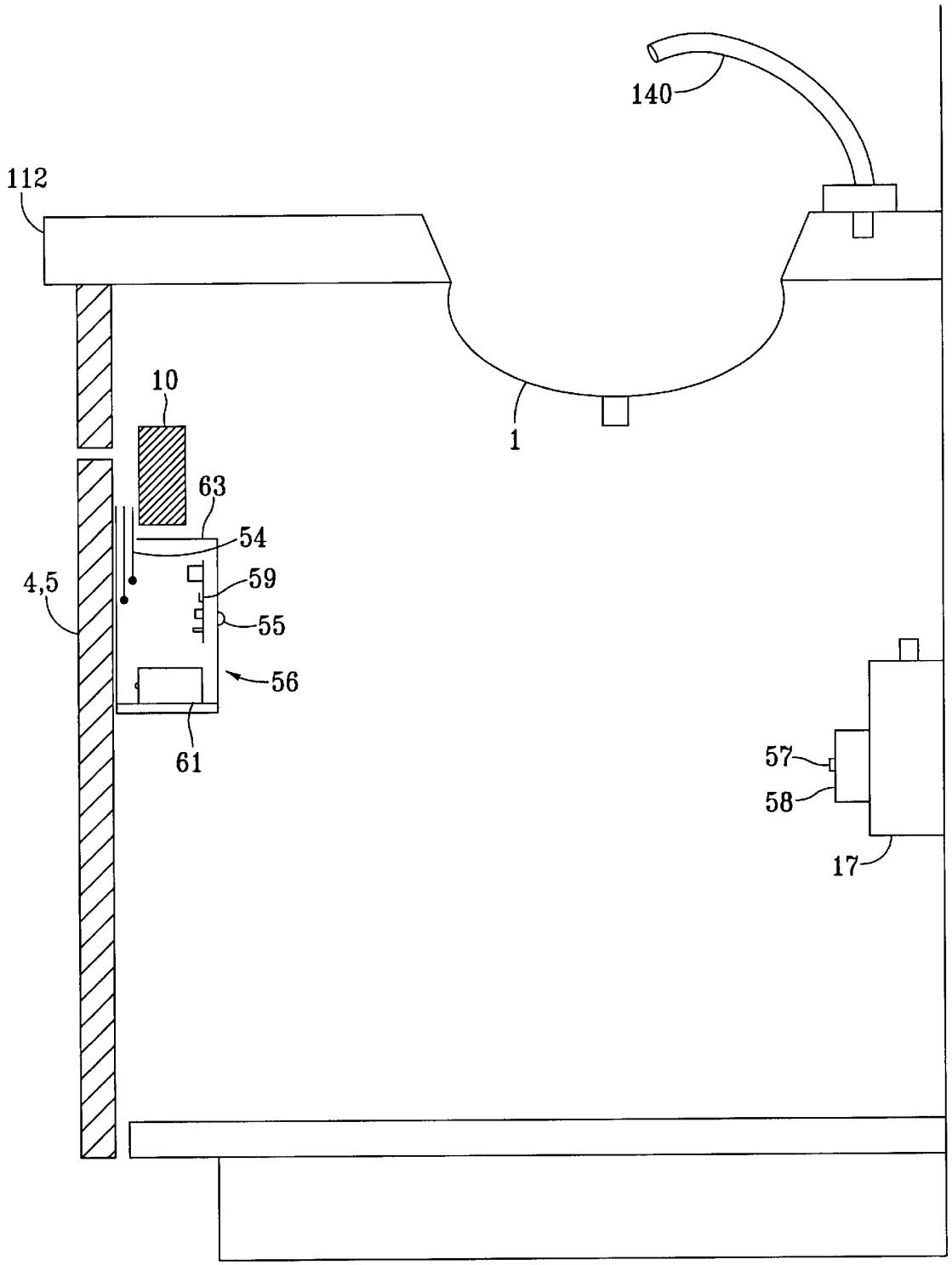
FIG. 12 is a cross-sectional view of a faucet, sink, and cabinet with the automatic faucet control valve system and the wireless control unit.

With reference to FIG. 12, in a further embodiment of the invention, one or both of the switches 21, 22 may be replaced with a contact switch 54 that activates a self-powered infrared or radio frequency (RF) transmitter 55 for wirelessly communicating with a matching receiver 57 separate from or integrated with the valve manifold 17, to activate the solenoid valves 19, 20 remotely and wirelessly. Also, a commercially available transmitter circuit board 59 along with a battery 61 and the contact switch 54 can be encased in a container 63 and attached by means of adhesive or fasteners to the upper inside of the cabinet door 4, 5 just below the door frame 10 in a manner such that when pressure is applied to the closed door 4, 5, the upper door frame 10 causes the contact switch 54 to close, thus activating the transmitter 55, sending coded instructions or signals to the receiver 57 to activate the solenoid valves 19, 20. A control unit 58 including a power switching circuit is associated with the receiver 57 to decode and amplify the coded emission from the infrared or RF transmitter 55 and activate or open the solenoid valves 19, 20. When the contact switch 54 opens, transmitting stops and the power switch unit cuts power to the solenoid valves 19, 20, causing them to close. Also, as will be described in more detail below, the contact switch 54 may be a variable-resistance switch to operate a servo valve for variable flow control. Although RF and infrared communication means have been described for communicating the switch with the valve 19, 20, it will be readily apparent to those skilled in the art that other wireless means may be used to accomplish this same purpose.

Figure 19:
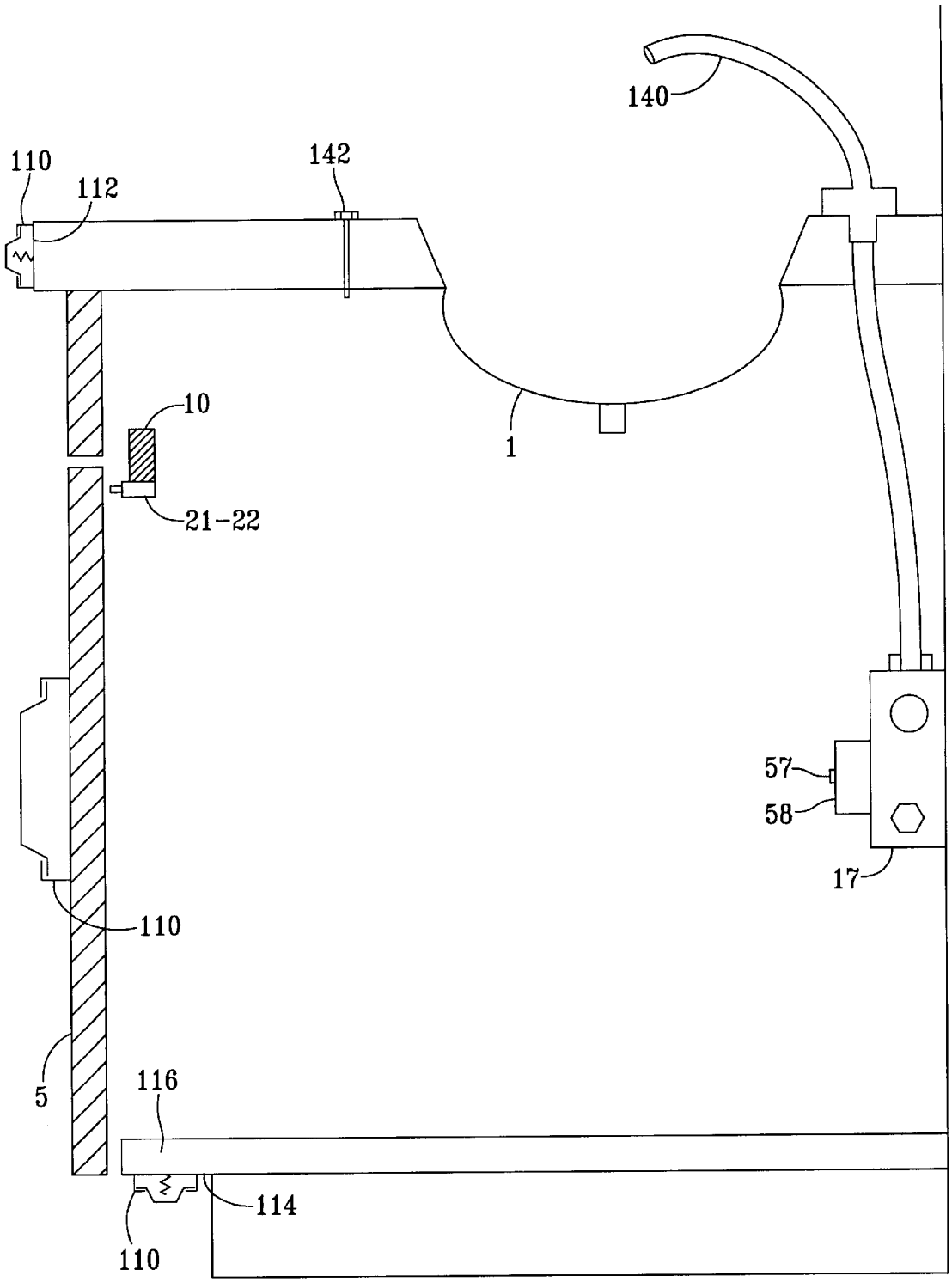
FIG. 19 is a cross-sectional view of a faucet, sink, and cabinet with an alternative embodiment of an automatic faucet control valve system and illustrates an alternative embodiment of a switch, in a variety of exemplary locations, that may be used with the automatic faucet control valve system.
Figure 20:
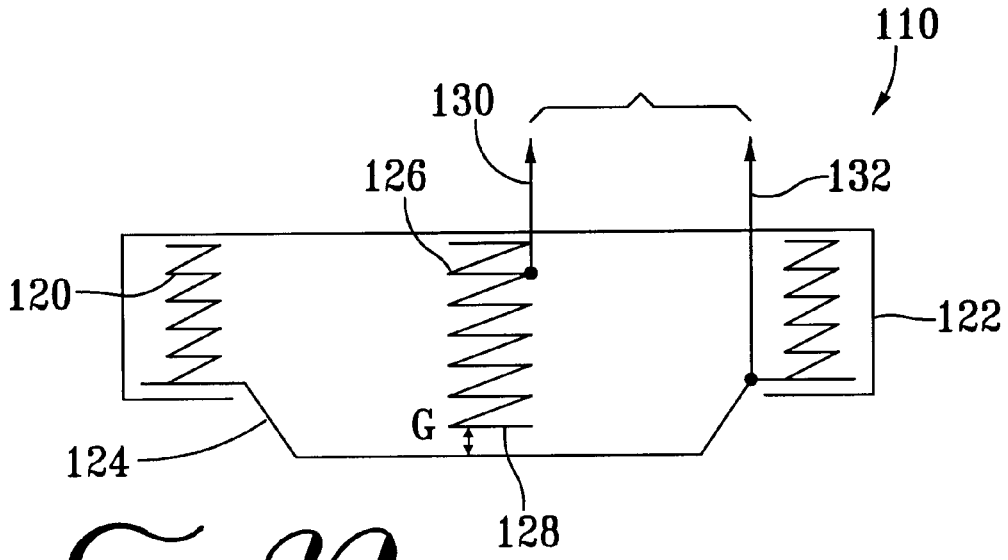
FIG. 20 is a perspective view of the switch illustrated in FIG. 19.
Figure 21:
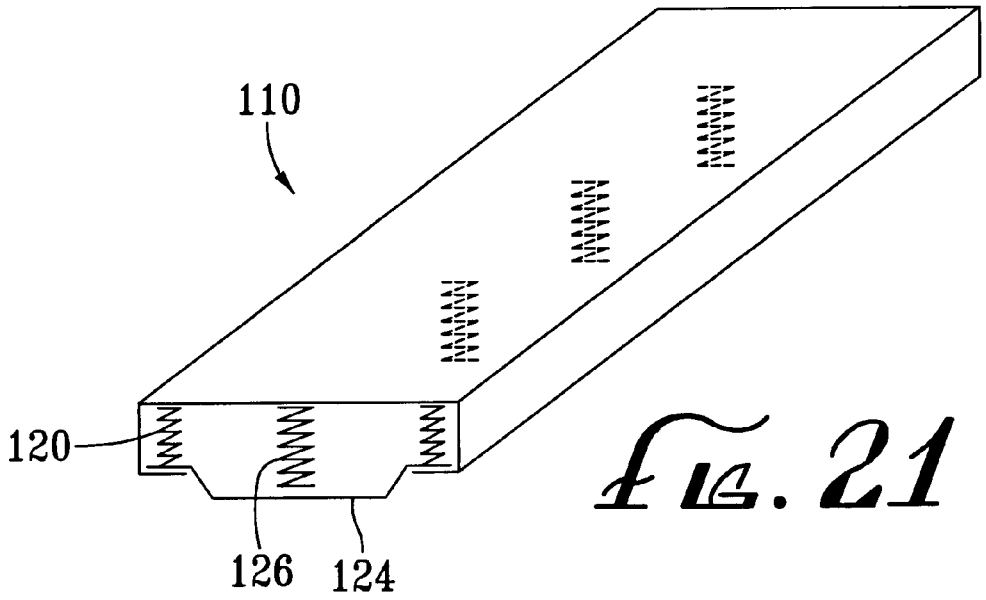
FIG. 21 is a cross-sectional view of the switch illustrated in FIG. 20.
Figure 22:
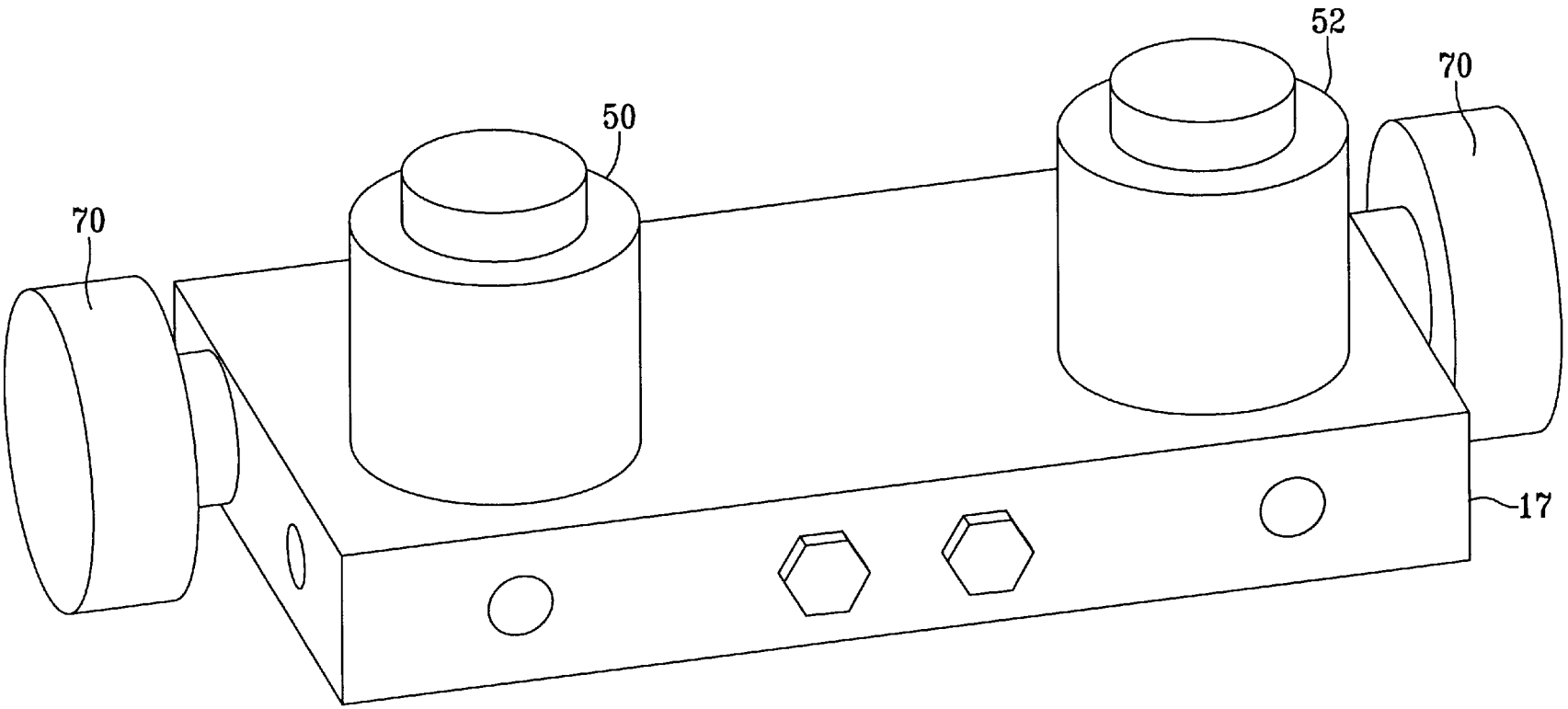
FIG. 22 is a perspective view of an embodiment of a valve manifold including a pair of servo valves, and automatic electrically actuated diversionary valves.

With reference to FIGS. 19-21, in an alternative embodiment of the invention, one or more lever-operated switches 110 may be strategically positioned on the cabinet or cabinet frame to control the valves 19, 20 in a wired or wireless manner such as that described immediately above. Although not shown, the switch 110 may include a transmitter and associated electronics such as that described above to achieve this purpose. The one or more lever-operated switches 110 may be located on a front edge 112 (FIGS. 12, 19) of the sink or cabinet, on a front surface of the cabinet door 4, 5 or to a bottom surface 114 of the cabinet frame.

In a preferred embodiment, the switch 110 is located on the bottom surface 114 of an overhang 116 of the cabinet frame, behind and below the cabinet door 4, 5, or in a similar location where the user can activate the switch 110 with upper toe pressure. Because the switch 110 is located above ground, but beneath the overhang 116, the switch 110 is not obtrusive or an obstacle to foot traffic, mopping, cleaning, etc. This location is also desirable because the user's feet normally extend underneath the overhand 116 of the cabinet, in the area underneath the switch 110. The valves 19, 20 are activated by simply lifting one's toes and applying pressure to the switch 110 with the upper side of one's toes.

With reference specifically to FIGS. 20 and 21, the switch 110 will now be described in detail. A series of electrically connected metallic springs 126 are attached to a non-metallic housing 122, just above a metallic strip lever 124. The metallic springs 126 include bottom ends 128 that are normally separated from the strip lever 124 by a gap G by the action of springs 120. The separation distance of the gap G should not be more than 1/8 to 3/16 inches. The metallic strip lever 124 is the first leg of the contact switch 110 and the springs 126 form the second leg of the contact switch 110. First and second conductive cables 130, 132 are connected to the strip lever 124 and the springs 126, respectively, to complete the circuit. By closing the gap G with the external pressure of, for example, a user's toe, the circuit is completed, activating the valves 19, 20. It will be readily apparent to those skilled in the art that other upper toe-activated switches may have alternative constructions such as, but not by way of limitation, reflective infrared emitter and detector switch that detects a nearby object such as a user's toe underneath the overhang 116.

With reference to FIGS. 4–19 in an alternative embodiment of the invention, a static sensitive switch circuit can be integrated to the existing control unit circuitry 58 or the infrared or RF transmitter circuitry 59 to activate solenoid 19, 20 conventionally or wirelessly. The input terminal of the static sensitive switch, which may be integrated in the control unit 58 or transmitter circuitry 59, can communicate by means of conductive cable to a ground isolated metallic probe such as a faucet spout 140, an uncoated metallic sink 1, or to numerous ornamental metallic probes such as a chrome plated button 142 (FIGS. 4, 19) placed at any location of convenience. Those skilled in the art will understand that there are almost no numerical limitations for such a metallic probe being connected to a single input terminal of such a static sensitive switch provided that all those metallic probes remain ground isolated. Although not shown, the switch 110 may include a transmitter and associated electronics such as that described above to achieve this purpose. The static-sensitive switch is similar to those used in touch-on, touch-off light fixtures. The switch includes a sensing terminal connected to a ground isolated metallic body of the sink 1 (stainless steel sink) or to a ground isolated spout of a faucet. To activate the valves 19, 20, the user touches, for example, an edge of the sink or spout of a faucet. To deactivate the valves, 19, 20, a second touch is required.

With reference to FIG. 10, the solenoid coils 31 of the solenoid valves 19, 20 are connected in parallel, and the connection to a low voltage transformer 18 is interrupted so long as the switches 21, 22 remain open. The solenoid valves 19, 20 are closed to water flow unless the coils 31 are energized when the switches 21, 22 are closed. Because the switches 21, 22 are normally open, they interrupt the connection of the solenoid coils 31 to the low voltage transformer 18, which serves as the power supply, until the switches 21, 22 are closed. For consumer safety, transformer 18 is preferably a 24 Volt step-down transformer that reduces the high wall reciprocal voltage to a safe handling voltage.

Latching switch 21 is adapted to stay in a closed position when activated (so as to cause a continuous flow of water), thereby continuously maintaining the connection of the solenoid coils 31 to the low voltage transformer 18 until the latchable switch 21 is engaged a second time, which re-opens the switch 21. The latching switch 22 also can be replaced by a momentary switch similar to switch 22 to activate a timer circuitry incorporated in control unit 58 to activate solenoids 19, 20 for a predetermined duration.

Instantaneous on-off control of water may be accomplished by the push button or momentary switch 22. The switch 22 remains closed, causing the solenoid valve(s) 19, 20 to remain open and water to flow to the faucet, as long pressure is imparted on the switch 22.

Figure 6:
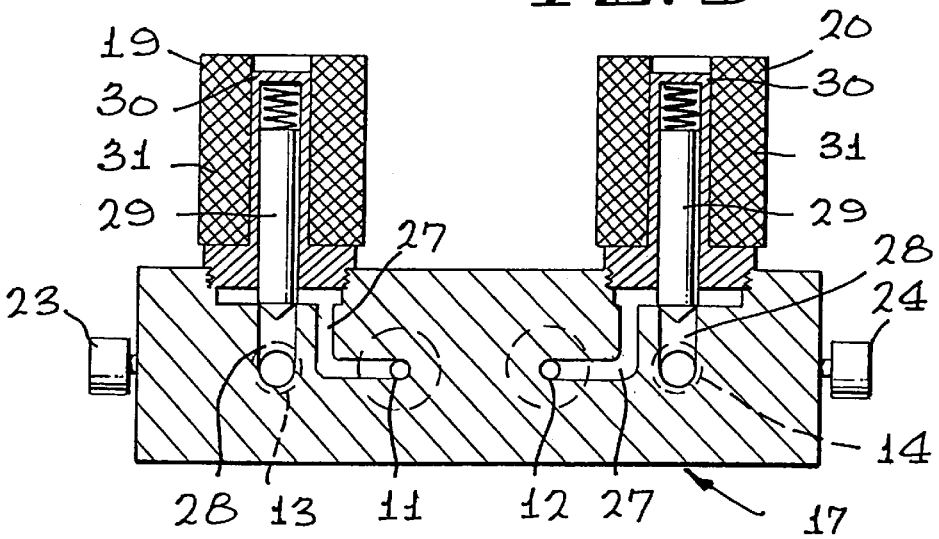
FIG. 6 is a cross-sectional view of the valve manifold taken through lines 6—6 of FIG. 5.
Figure 7:
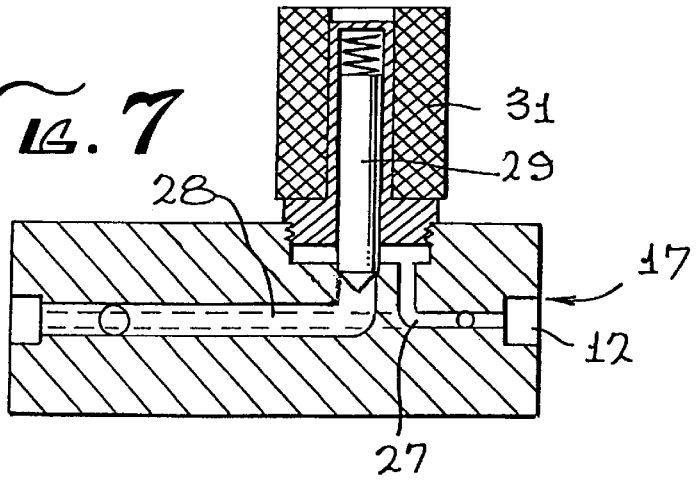
FIG. 7 is a cross-sectional view of the valve manifold taken through lines 7—7 of FIG. 5.

The valve manifold inlet ports 11, 12 are denied access to the valve manifold outlet ports 13, 14 (FIG. 8) by the action of needle valves 23, 24 at point 25, 26 and by the inactivated solenoid valves 19, 20 (FIG. 6). Solenoid valves 19, 20 are typical, normally closed solenoid valves which restrict the water flow through their inlet port 27 and the outlet port 28. Because the internal configuration of a normally closed solenoid valve is not part of the claimed invention, those of ordinary skill in the art will recognize that any suitable configuration for a normally closed solenoid valve may be adopted. However, for purposes of illustration, FIG. 6 shows the function of a basic dual solenoid valve arrangement consisting of spring-loaded non-corrosive magnetic plungers 29 and guides 30, electromagnetic coils 31 and valve manifold with inlet ports 11, 12 and outlet ports 13, 14.

In a non-actuated mode, the spring-loaded plunger 29 of FIG. 6, aided by water pressure of inlet ports 11, 12, creates a positive seal against the outlet port 28 of the solenoid valves, 19, 20 thus restricting the water flow.

In the activated mode, the energized magnetic coil 31 causes the plunger 29 to move upward, thus removing the obstacle of communication between valve manifold inlet ports 11, 12 and valve manifold outlet ports 13, 14 of the solenoid valves 19, 20. In the activated mode, the two solenoid valves 19, 20 simultaneously open, permitting unrestricted water flow through their outlet ports 28, and consequently to the-sink faucet, as its settings permit.

Figure 11:
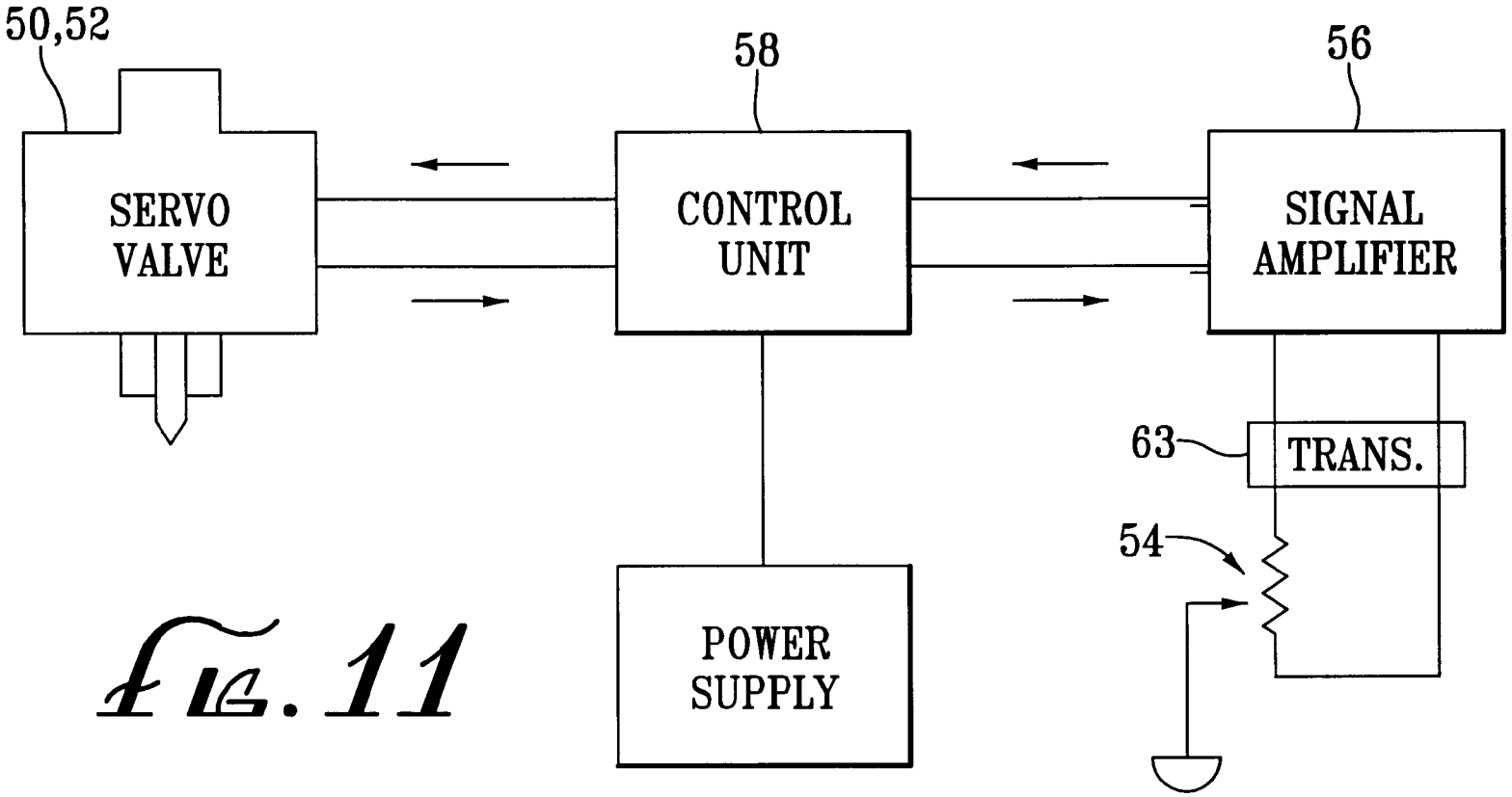
FIG. 11 is a schematic illustration of an automatic faucet control valve system constructed in accordance with a further embodiment of the present invention.
Figure 13:
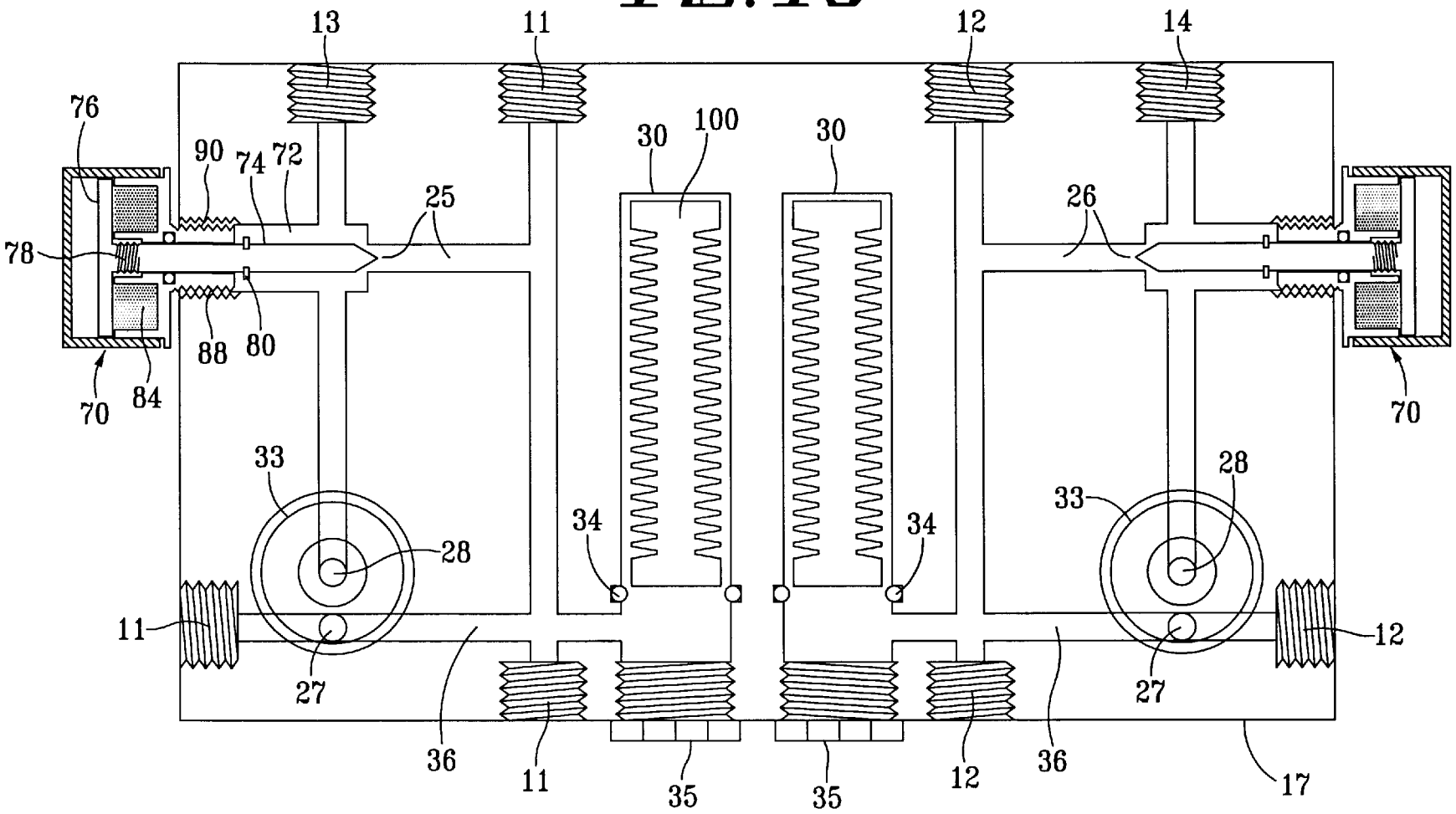
FIG. 13 is a cross-sectional view, similar to FIG. 8, of an automatic faucet control valve system constructed in accordance with a still further embodiment of the present invention.
Figure 14:
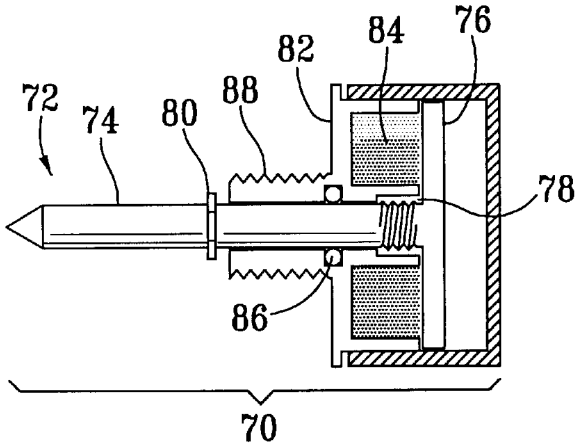
FIGS. 14 and 15 are cross-sectional views of an automatic electrically actuated needle valve assembly constructed in accordance with an embodiment of the invention.

With reference to FIGS. 11, 12, and 13 in an alternative embodiment of the invention, the solenoid valves 19, 20 may be replaced with one or more variable liquid flow control valves that allow the user to more precisely control the flow rate through the valve manifold 17. For example, but not by way of limitation, the solenoid valves 19, 20 may be replaced with respective servo valves 50, 52 or servo-operated plungers to provide variable liquid flow control in the valve manifold 17. It should be noted, replacing the solenoid valves 19, 20 with servo valves 50, 52 may even be done within the same valve manifold 17 with little or no changes to the valve seats of the manifold 17 because the valve seats may be designed for valve interchangeability.

To control the servo valves 50, 52, one or both of the switches 21, 22 may be replaced with a pressure sensitive switch such as a variable resistance push switch 54, a transmitter unit 63 (infrared or RF), a receiver 57, a signal amplifier 56, and control unit 58 to operate one or both servo valves 50, 52. Of course, in an alternative embodiment, a wired connection may exist between the pressure sensitive switch and the control unit 58. The resistance of undisturbed switch 54 is set to maintain servo valve or servo plunger 50, 52 in a closed condition. Increasing or decreasing the pressure on the cabinet door 4,5 changes the resistance of the variable resistance push switch 54, which is amplified by the signal amplifier 56 and processed by the control unit 58 to control one or both of the servo valves 50, 52 to provide variable fluid control through the open faucet. Preferably, this embodiment would be configured so that as the pressure on the cabinet door 4, 5 is increased by the user, the flow rate through the servo valve(s) 50, 52 would proportionately increase.

It will be readily apparent to those skilled in the art that other pressure sensitive switches may be used to provide variable control of the valves.

In another embodiment of the invention, instead of the aforementioned control switches controlling both of the solenoid valves 19, 20 or variable flow control valves 50, 52 simultaneously, respective control switches may be used to control respective hot and cold water valves in the valve manifold 17 to independently control the relative amounts of hot and cold water going to the faucet. This would reduce the need for the hot and cold water handles 2, 3 for the faucet.

Figure 8:
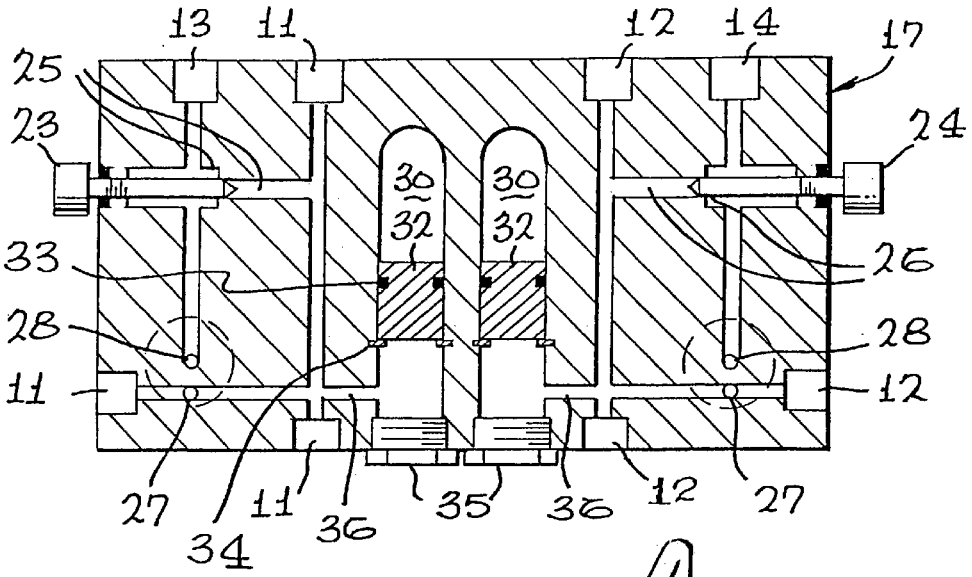
FIG. 8 is a cross-sectional view of the valve manifold taken through lines 8—8 of FIG. 5.

With reference to FIG. 8, a pair of needle valve assemblies 23 allow a user to manually bypass the solenoid valves 19, 20 for the free flow of fluid through the valve manifold 17 in the event of a power failure or malfunction, or for any other reason. A needle valve 24 of the needle valve assembly 23 may be manually withdrawn (at least partially) from bores 25, 26 to allow free irrigational communication between inlet ports 11, 12 and outlet ports 13, 14 of valve manifold 17 in order to bypass the closed solenoid valves 19, 20.

With reference to FIGS. 13–16, a pair of automatic electrically actuated needle valve assemblies 70 that automatically open in the event of a power failure or malfunction so that the solenoid valves 19, 20 are bypassed for the free flow of fluid through the valve manifold 17 will now be described. The automatic electrically actuated needle valve assemblies 70 may physically replace the manually actuated needle valve assemblies 23 discussed above. The needle valve assembly 70 includes a needle valve stem 74 attached to a circular magnetically excitable plate 76. The needle valve stem 74 carries a spring 78 adjacent to the plate 76 and a retaining ring 80.

The needle valve stem 74 is disposed in the bore of a magnetically excitable flange 82 having magnetic coil 84 in the center. The flange 82 carries an O ring 86 and includes an external thread 88 compatible with a internal thread 90 in the valve manifold 17, making retrofitting or replacement of the manually operable needle valve assembly 23 easy, inexpensive, and standardized. The retaining ring 80 insures the limited movement of the needle valve stem 74 with respect to the flange 82 and the O ring 86 insures proper fluid seals between the needle valve stem 74 and the flange 82.

Figure 16:
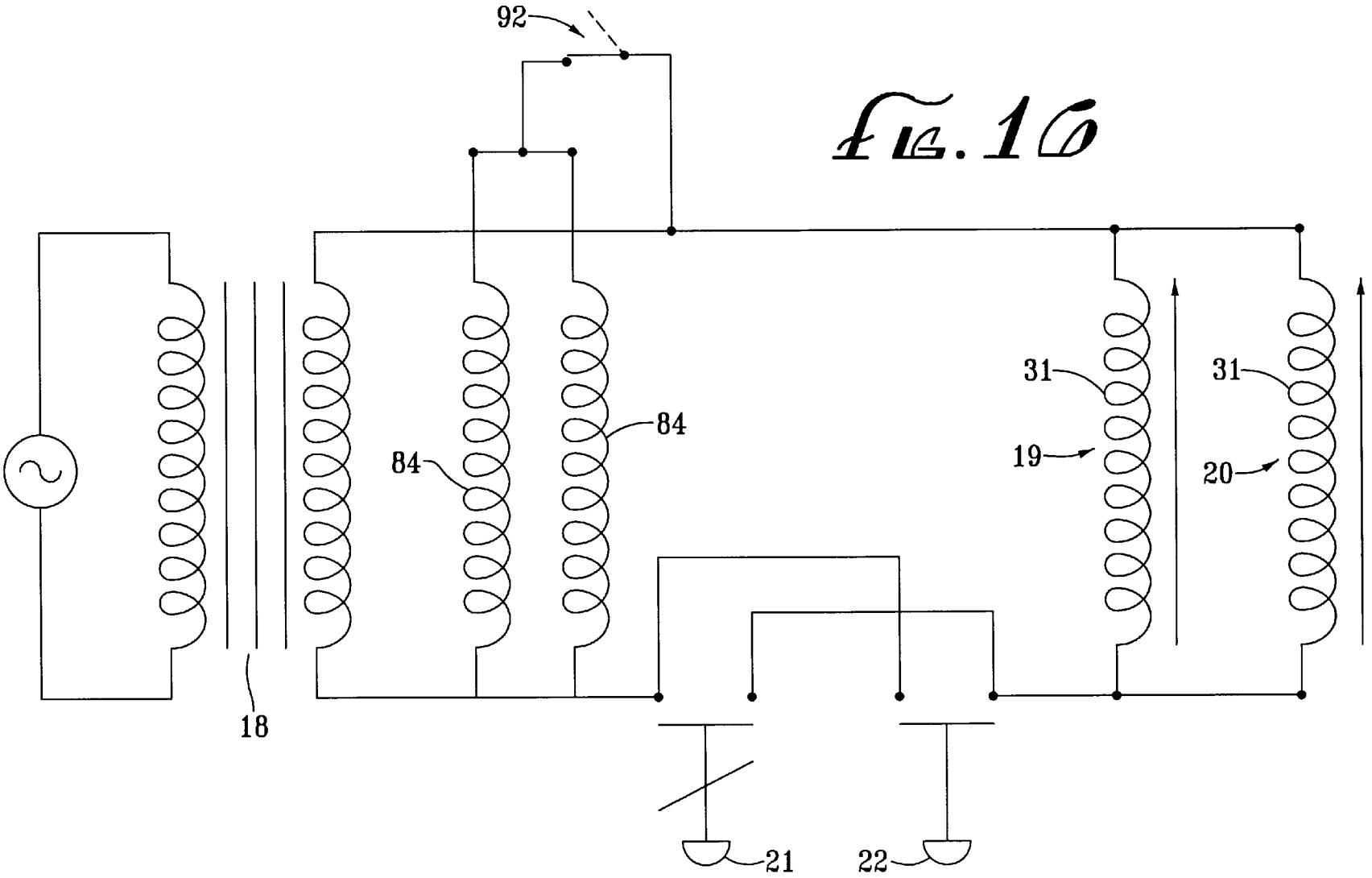
FIG. 16 is an exemplary simplified circuit diagram of the automatic faucet control valve system illustrated in FIG. 13.

With reference to FIG. 16, the magnetic coils 84 are connected in parallel through a normally closed switch 92 and are in constant communication with the power supply 18, resulting in magnetization of flange 82 and, as a result, a constant pull on plate 76. The constant pull on plate 76 causes needle valve stem 74 to close the manifold bores 25, 26, preventing water flow there through.

In the event of a power failure or opening of switch 92, the flange 82 demagnetizes. The lack of pull on the plate 76, along with the action of spring 78 and fluid pressure in bore 25, 26, forces the valve stem 74 backward, causing the free communication of fluid between the inlet ports 11, 12 and the outlet ports 13, 14 in the valve manifold 17. When the supply of power is resumed or the switch 92 is closed, the magnetized flange 84 attracts plate 76, thus closing the bore passage way 25, 26 and causing the valve manifold 17 to resume to its normal operating condition.

Figure 17:
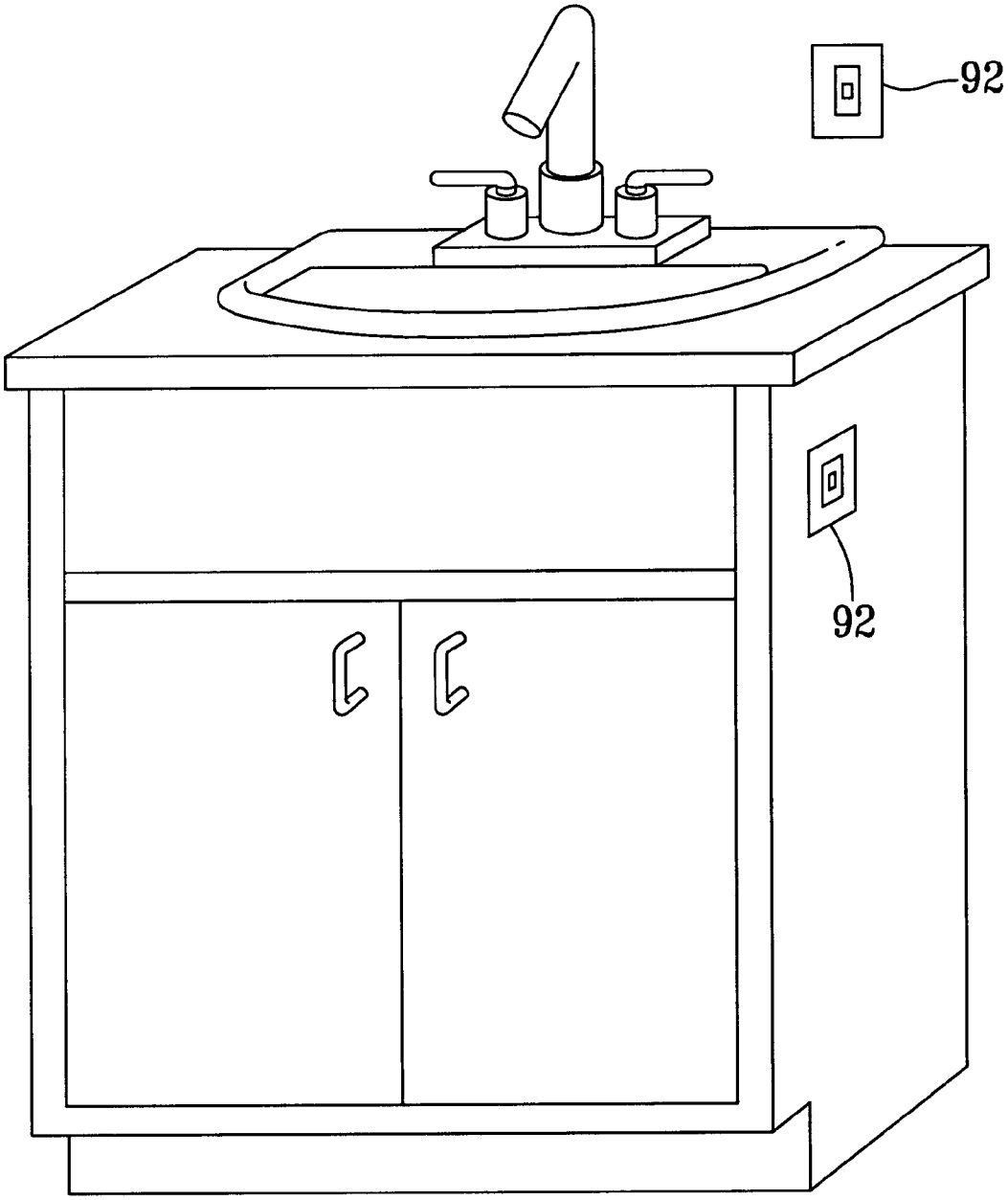
FIG. 17 is a perspective view of a faucet, sink, and cabinet and shows exemplary locations of a switch that may be used with the automatic faucet control valve system illustrated in FIG. 16.

With reference to FIG. 17, the switch 92 may be conveniently located on a wall behind or adjacent to the sink or on a cabinet fixture so that by opening the switch 92, the operator can override or bypass the valves 19, 20 so that the faucet works manually and conventionally if so desired.

With reference to FIG. 8, the valve manifold 17 may include a hammer arrestor device to provide a shock absorbing environment to minimize the hammering action and related noises that may be generated by the sudden closing action of the solenoid valves 19, 20. For example, such a device may be comprised of two cylindrical cavities 30 filled with compressed air and sealed by two pistons 32 containing O-rings 33 as a seal, and retaining rings 34 to retain the pistons 32 within the cylindrical cavities 30. The lower end of each of the two cylindrical cavities, on the uncompressed side of the piston 32, may be sealed by threaded plugs 35 and connected by passage ways 36 to water inlets 11, 12.

The sudden shock caused by the closing action of the solenoid valves 19, 20 passes through bores 36 and causes the pistons 32 to move against the preset pressurized cavities 30, thus absorbing the shock and hammer effect of sudden closure.

Figure 18:
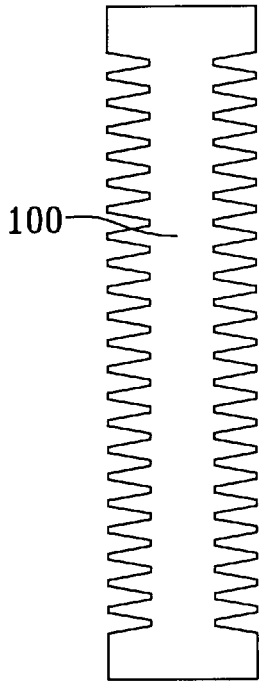
FIG. 18 is a cross-sectional view of an embodiment of a hammer arrestor device that may be used with the automatic faucet control valve system illustrated in FIG. 13.
Figure 15:
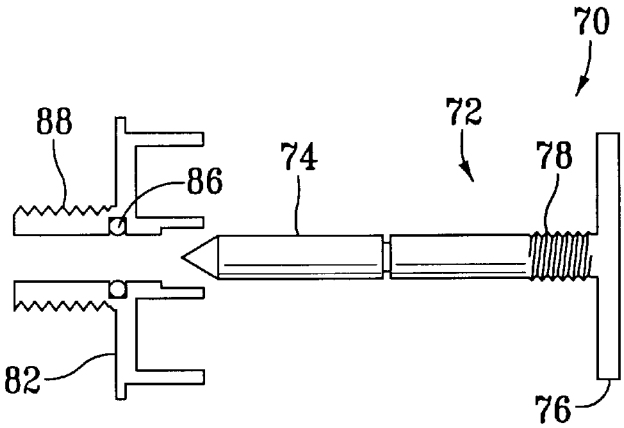

With reference to FIGS. 13 and 18, in another embodiment, the hammer arrestor device may include a flexible air bag 100 made out of a thin wall of corrugated stainless steel cylinder that is pressurized with predetermined quantity of compressed air and sealed at both ends. Cylindrical cavities 30 in the valve manifold 17 may be filled with a compressed air to absorb the hammering effect. When placed in cavity 30 (FIG. 13), the longitudinal flexibility of the corrugated cylinder 100 will absorb the sudden impact and hammering effect of sudden valve closure.

The present invention will now be described in use. Slight knee pressure on one of the cabinet doors 4, 5 causes the switch 21, 22 to close, in turn causing the solenoid valve(s) 19, 20 to open, allowing the water to flow freely through the existing faucet as its flow settings permits.

Continuous water flow may be accomplished by way of the push button latchable switch 21. To latch the latchable switch 21, a light knee pressure is applied to one of the cabinet doors 4, 5. In the latch mode, the solenoid valve(s) 19, 20 remain open indefinitely and the faucet works conventionally, and the user can manipulate the water flow manually and conventionally or terminate the flow by applying a second knee pressure to the same cabinet door 4, 5 or by turning the faucet manually to the off position.

Instantaneous on-off control of water may be accomplished by the push button or momentary switch 22. The switch 22 remains closed, causing the solenoid valve(s) 19, 20 to remain open and water to flow to the faucet, as long pressure is imparted on the switch 22.

Variable control may be accomplished by the variable control or pressure sensitive switch 54. Increasing or decreasing the pressure on the cabinet door 4,5 changes the resistance of the variable resistance push switch 54, which is amplified by the signal amplifier 56 and processed by the servo control unit 58 to control one or both of the valves 50, 52 to provide variable fluid control through the open faucet. If a static-sensitive switch is used, the touch-on, touch-off control of water can be accomplished by the user by touching a metallic object such as uncoated metallic sink 1, a faucet spout 140, or an ornamental metallic button 142 (FIG. 4, 19). The static-sensitive switch should be ground isolated, placed in a location of convenience, and should be in communication with the input terminal of the touch sensitive switch.

To child proof the invention, all that is necessary is to close the sink faucet manually. In this case, if a child exerts pressure on the doors 4, 5, the solenoid valves 19, 20 will activate, but the closed sink faucet restricts the flow.

In the event that the solenoid valves 19, 20 become fixed in a closed condition due to a power failure or malfunction, manually operable needle valve assemblies 23 allow a user to manually bypass the solenoid valves 19, 20 and automatic electrically actuated needle valve assemblies 70 automatically open to bypass the solenoid valves 19, 20 for the free flow of water through the valve manifold 17 and to the faucet. The remote switch 92 may be used with the electrically actuated needle valve assemblies 70 to control the opening of the electrically actuated needle valve assemblies 70 in the event of a power failure or malfunction.

The illustrated embodiment is exemplary in nature and many of the details thereof could be modified without departing from the spirit and scope of the present invention. For example, the internal configuration of the solenoid valves 19, 20 could be of a different type, such as a piloted solenoid valve, which can rely on storage energy of the battery cell for its operations. It must also be noted that such piloted solenoid valves can also work with dual energy source such as battery cells and AC current, or as described above, a servo valve. The general shape of the valve manifold 17 could also be different. For example, a single valve manifold 17 could be replaced with two separate manifolds or blocks, each containing a solenoid valve, a diversionary valve, and multiple inlet ports for a single fluid, e.g., hot water. Style-wise, the inlet or outlet ports may be configured differently or the switching apparatus, namely control unit 58, can contain an electronic version of the latching switch, replacing the mechanical latching switch with a momentary switch. Control unit 58 can also contain a static sensitive switch or a timer circuitry for measured fluid flow or a voice activated switch which converts voice commands to a working current to activate solenoid valves 19–20. To reduce consumer cost, the shock-absorbing portion may be simplified or eliminated.

The arrangement of the present invention makes the automatic valve control system advantageously very easy to install as a retrofit or with new faucet plumbing, even by non-plumber consumers. Its simplicity and minimal parts makes it inexpensive, and its practicality and ease of operation encourage its use. Those of ordinary skill in the art will understand that other changes and modifications can be made to the invention within the scope of the appended claims.

I claim:

1. An automatic control system for a faucet of a sink, comprising:

a valve manifold adapted to be disposed beneath said sink, said valve manifold adapted to communicate with at least one of a hot water supply line and a cold water supply line and at least one of a hot water faucet connecting line and a cold water faucet connecting line for delivering water to the faucet of said sink, said valve manifold including at least one electrically actuatable valve for controlling the flow of water to at least one of the hot water faucet connecting line and the cold water faucet connecting line, said at least one electrically actuatable valve adapted to electrically communicate with an electrical power supply;

at least one switch adapted to selectively cause a connection between said electrical power supply and said at least one electrically actuatable valve to be completed, whereby, upon completion of said connection, said at least one electrically actuatable valve at least partially opens to allow the flow of water to the faucet; and said valve manifold including a diversionary valve adapted to allow water in said valve manifold to bypass said at least one electrically actuatable valve and flow to said at least one of the hot water faucet connecting line and the cold water faucet connecting line.

2. The automatic control system of claim 1, wherein said diversionary valve includes a manually operable diversionary valve.

3. The automatic control system of claim 1, wherein said diversionary valve includes an automatic electrically actuatable diversionary valve adapted to open when power ceases to be supplied to said automatic electrically actuatable diversionary valve.

4. The automatic control system of claim 3, wherein said automatic electrically actuatable diversionary valve includes a biasing mechanism adapted to urge said automatic electrically actuatable diversionary valve closed when said automatic electrically actuatable diversionary valve is supplied with electricity and urge said automatic electrically actuatable diversionary valve open when said automatic electrically actuatable diversionary valve is not supplied with electricity.

5. The automatic control system of claim 4, wherein said biasing mechanism includes an electromagnetic mechanism adapted to close said automatic electrically actuatable diversionary valve when said electromagnetic mechanism is supplied with electricity and a spring adapted to open said automatic electrically actuatable diversionary valve when electricity is not supplied to said electromagnetic mechanism.

6. The automatic control system of claim 1, wherein said valve manifold is adapted to be disposed beneath said sink, inside a cabinet frame having a pair of hinged doors mounted thereon, said at least one switch adapted to be mounted to the cabinet frame, at least one of said doors including an internal surface facing the inside of the cabinet and adapted to contact said at least one switch when said at least one door is substantially closed, said at least one switch adapted to be activated by the internal surface of said at least one door when pressure is applied to an external surface of said at least one door.

7. The automatic control system of claim 6, wherein said at least one switch includes a latching switch that, upon being activated a first time, maintains completion of the connection of said electrical power supply and said solenoid valves until the switch is reactivated.

8. The automatic control system of claim 6, wherein said at least one switch includes a momentarily non-latching switch.

9. The automatic control system of claim 6, wherein said at least one switch and said at least one valve are adapted to provide variable flow control in said valve manifold proportionate to the amount of pressure applied to the external surface of said at least one door.

10. The automatic control system of claim 9, wherein said at least one switch includes a variable-resistance push switch and said at least one electrically actuatable valve includes a servo valve.

11. The automatic control system of claim 9, further including a wireless mechanism adapted to communicate said at least one switch with said at least one electrically actuatable valve to control said at least one electrically actuatable valve.

12. The automatic control system of claim 11, wherein said wireless mechanism includes a transmitter associated with the at least one switch, and a receiver and a control unit associated with said valve manifold, said transmitter adapted to transmit a signal indicative of the state of said at least one switch to said receiver which communicates the signal to said control unit for control of said at least one electrically actuatable valve.

13. An automatic control system for a faucet of a sink, comprising:

a valve manifold adapted to be disposed beneath said sink, inside a cabinet frame having a pair of hinged doors mounted thereon, said valve manifold supply line and a cold water supply line and at least one of a hot water faucet connecting line and a cold water faucet connecting line for delivering water to the faucet of said sink, said valve manifold including at least one electrically actuatable valve for controlling the flow of water to at least one of the hot water faucet connecting line and the cold water faucet connecting line, said at least one electrically actuatable valve adapted to electrically communicate with an electrical power supply;

at least one switch adapted to be mounted to the cabinet frame, at least one of said doors including an internal surface facing the inside of the cabinet and adapted to contact said at least one switch when said at least one door is substantially closed, said at least one switch adapted to be selectively activated by the internal surface of said at least one door when pressure is applied to an external surface of said at least one door so as to cause a connection between said electrical power supply and said at least one electrically actuatable valve to be completed, whereby, upon completion of said connection, said at least one valve at least partially opens to allow the flow of water to the faucet.

14. The automatic control system of claim 13, wherein said at least one switch includes a latching switch that, upon being activated a first time, maintains completion of the connection of said electrical power supply and said at least one electrically actuatable valve until the switch is reactivated.

15. The automatic control system of claim 13, wherein said at least one switch includes a momentarily non-latching switch.

16. The automatic control system of claim 13, wherein said at least one switch and said at least one valve are adapted to provide variable flow control in said valve manifold proportionate to the amount of pressure applied to the external surface of said at least one door.

17. The automatic control system of claim 16, wherein said at least one switch includes a variable-resistance push switch and said at least one electrically actuatable valve includes a servo valve.

18. The automatic control system of claim 13, further including a wireless mechanism adapted to communicate said at least one switch with said at least one electrically actuatable valve to control said at least one electrically actuatable valve.

19. The automatic control system of claim 18, wherein said wireless mechanism includes a transmitter associated with the at least one switch, and a receiver and a control unit associated with said valve manifold, said transmitter adapted to transmit a signal indicative of the state of said at least one switch to said receiver which communicates the signal to said control unit for control of said at least one electrically actuatable valve.

20. The automatic control system of claim 19, wherein said at least one switch includes a static sensitive switch adapted to be coupled with an uncoated metallic sink, a metallic faucet spout or at least one metallic ornamental probe placed in a location of convenience for contact thereof and said control unit for control of said at least one electrically actuatable valve, said static sensitive switch coupled to said control unit via said transmitter and said receiver.

21. The automatic control system of claim 13, wherein said valve manifold includes a diversionary valve adapted to allow water in said valve manifold to bypass said at least one electrically actuatable valve and allow flow to at least one of the hot water faucet connecting line and the cold water faucet connecting line.

22. The automatic control system of claim 21, wherein said diversionary valve includes a manually operable diversionary valve.

23. The automatic control system of claim 21, wherein said diversionary valve includes an automatic electrically actuatable diversionary valve adapted to open when power ceases to be supplied to said automatic electrically actuatable diversionary valve.

24. The automatic control system of claim 23, wherein said automatic electrically actuatable diversionary valve includes a biasing mechanism adapted to urge said automatic electrically actuatable diversionary valve closed when said automatic electrically actuatable diversionary valve is supplied with electricity and urge said automatic electrically actuatable diversionary valve open when said automatic electrically actuatable diversionary valve is not supplied with electricity.

25. The automatic control system of claim 24, wherein said biasing mechanism includes an electromagnetic mechanism adapted to close said automatic electrically actuatable diversionary valve when said electromagnetic mechanism is supplied with electricity and a spring adapted to open said automatic electrically actuatable diversionary valve when electricity is not supplied to said electromagnetic mechanism.

26. The automatic control system of claim 13, wherein said at least one switch includes a switch adapted to be activated by an upper side of a user's foot.

27. The automatic control system of claim 13, wherein said at least one switch includes a static sensitive switch adapted to be coupled with an uncoated metallic sink or a metallic faucet spout and a control unit for control of said at least one electrically actuatable valve.

28. The automatic control system of claim 13, wherein said at least one switch includes a static sensitive switch adapted to be coupled with at lest one metallic ornamental probe placed in a location of convenience for contact thereof and a control unit for control of said at least one electrically actuatable valve.

* * * * *